US009657576B2

(12) United States Patent
Ramm et al.

(10) Patent No.: US 9,657,576 B2
(45) Date of Patent: May 23, 2017

(54) AIRFOIL HAVING A PROFILED TRAILING EDGE FOR A FLUID FLOW MACHINE, BLADE, AND INTEGRALLY BLADE ROTOR

(71) Applicant: MTU Aero Engines AG, Munich (DE)

(72) Inventors: Guenter Ramm, Eichenau (DE); Christine Lang, Bergkirchen (DE)

(73) Assignee: MTU Aero Engines AG, Munich (DE)

( * ) Notice: Subject to any disclaimer, the term of this patent is extended or adjusted under 35 U.S.C. 154(b) by 413 days.

(21) Appl. No.: 14/248,037

(22) Filed: Apr. 8, 2014

(65) Prior Publication Data

US 2014/0301860 A1 Oct. 9, 2014

(30) Foreign Application Priority Data

Apr. 9, 2013 (DE) ..... 10 2013 206 207

(51) Int. Cl.

| | |
|---|---|
| ***F01D 5/04*** | (2006.01) |
| ***F01D 5/14*** | (2006.01) |
| ***F04D 29/32*** | (2006.01) |
| ***F04D 29/68*** | (2006.01) |

(52) U.S. Cl.

CPC ..... *F01D 5/145* (2013.01); *F01D 5/142* (2013.01); *F04D 29/324* (2013.01); *F04D 29/681* (2013.01); *F05D 2240/122* (2013.01); *F05D 2240/304* (2013.01); *F05D 2250/18* (2013.01); *F05D 2260/96* (2013.01)

(58) Field of Classification Search

CPC ..... F01D 5/145; F01D 5/142; F04D 29/324; F04D 29/681; F05D 2240/122; F05D 2240/304; F05D 2250/18; F05D 2260/96

See application file for complete search history.

(56) References Cited

U.S. PATENT DOCUMENTS

| | | | | | |
|---|---|---|---|---|---|
| 1,366,635 | A * | 1/1921 | Conway | B64C 11/16 | 416/236 R |
| 4,089,618 | A * | 5/1978 | Patel | F04D 29/668 | 416/228 |
| 4,714,408 | A | 12/1987 | Abe | | |
| 4,813,633 | A * | 3/1989 | Werle | B63H 9/0607 | 244/130 |
| 4,830,315 | A * | 5/1989 | Presz, Jr. | B64C 21/10 | 114/102.29 |
| 5,074,376 | A * | 12/1991 | Powell | B63H 1/28 | 181/277 |
| 5,533,865 | A * | 7/1996 | Dassen | F03D 1/0608 | 244/200 |

(Continued)

FOREIGN PATENT DOCUMENTS

| | | |
|---|---|---|
| EP | 0273851 | 7/1988 |
| EP | 0273851 A2 | 7/1988 |

(Continued)

*Primary Examiner* — Jessica Cahill

(74) *Attorney, Agent, or Firm* — Davidson, Davidson & Kappel, LLC

(57) ABSTRACT

The present invention relates to an airfoil for a fluid flow machine (100), having a suction side (5), a pressure side (7) and an airfoil trailing edge (200). The airfoil (100), at least in portions thereof, has a profile (9) in the region of the airfoil trailing edge (200), which profile extends over the suction side (5) and the pressure side (7) of the airfoil trailing edge (200). The present invention also relates to a blade and an integrally bladed rotor.

9 Claims, 8 Drawing Sheets

(56) References Cited

U.S. PATENT DOCUMENTS

| | | | | |
|---|---|---|---|---|
| 6,435,815 | B2 * | 8/2002 | Harvey | F01D 5/145 415/115 |
| 6,733,240 | B2 * | 5/2004 | Gliebe | F01D 5/141 416/228 |
| 7,549,844 | B2 | 6/2009 | Liang | |
| 8,029,242 | B2 * | 10/2011 | Teraoka | F04D 17/04 416/223 R |
| 8,608,429 | B2 * | 12/2013 | Gupta | F01D 5/145 415/115 |
| 8,794,927 | B2 * | 8/2014 | Vassilicos | F15D 1/10 416/228 |
| 2004/0179943 | A1 * | 9/2004 | Beeck | F01D 5/145 416/180 |
| 2008/0014095 | A1 * | 1/2008 | Moniz | F01D 5/141 416/97 R |
| 2010/0150731 | A1 * | 6/2010 | Zhang | F04D 29/281 416/90 R |
| 2011/0044818 | A1 * | 2/2011 | Kuhne | F01D 5/143 416/212 A |

FOREIGN PATENT DOCUMENTS

| | | |
|---|---|---|
| EP | 0375296 | 6/1990 |
| EP | 1112928 A2 | 7/2001 |
| GB | 293656 | 7/1928 |
| JP | S61279800 | 12/1986 |

* cited by examiner

AIRFOIL HAVING A PROFILED TRAILING EDGE FOR A FLUID FLOW MACHINE, BLADE, AND INTEGRALLY BLADE ROTOR

This claims the benefit of German Patent Application DE 10 2013 206 207.9, filed Apr. 9, 2013 and hereby incorporated by reference herein.

The present invention relates to an airfoil for a fluid flow machine, in particular a gas turbine blade, having a suction side, a pressure side, and an airfoil trailing edge. The present invention also relates to a blade, and an integrally bladed rotor.

BACKGROUND

In practice, there are known airfoils for fluid flow machines or turbine blades whose airfoils have different trailing edge geometries in order, for example, to achieve a noise reduction and/or higher efficiency.

SUMMARY OF THE INVENTION

It is an object of the present invention to provide another airfoil for fluid flow machines, whose airfoil trailing edge is profiled at least in a portion thereof. Another object of the present invention is to provide a blade and an integrally bladed rotor.

The present invention provides an airfoil which, at least in portions thereof, has a profile in the region of the airfoil trailing edge, which profile extends over the suction side and the pressure side of the airfoil trailing edge. Such an airfoil can be used as a stator vane and/or as a rotor blade in fluid flow machines and/or turbines and/or bladed disks (BLISKS) and/or bladed rings (BLINGS), and be configured accordingly.

In all of the above and following discussion, the expressions "may be" and "may have", etc., will be understood to be synonymous with "is preferably" and "preferably has", etc., and are intended to illustrate specific embodiments according to the present invention.

Advantageous refinements of the present invention are the subject matter of the respective dependent claims and specific embodiments.

Specific embodiments of the present invention may include one or more of the features mentioned below.

The term "profile" as used herein refers to a pattern or geometric shape extending both over portions of the suction side and over portions of the pressure side in the region of the airfoil trailing edge. Thus, in accordance with the present invention, a "profile" extends both on the suction side and on the pressure side. The profile sub-sections on the suction side and the pressure side may be shaped differently. In certain embodiments according to the present invention, the profile sub-section on the suction side may, for example, have patterned surface roughnesses or surface depressions while, for example, edges, curvatures, or steps may be provided on the pressure side, or vice versa.

A profile may have patterns or shapes to create specific functional features in order, for example, to selectively influence the flow around the airfoil trailing edge. For example, a flow separation edge may be obtained by the profile.

In several embodiments of the present invention, at least one, possibly localized, "wake region" extends downstream of the flow separation edge. This wake region forms due to the enlargement in cross section caused by the flow separation edge. The flow; i.e., its laminar or turbulent flow pattern, cannot follow this discontinuous enlargement in cross section. Therefore, in addition to the continuing (laminar or turbulent) flow pattern, a further flow region is formed, which may be referred to as "wake region." In this wake region, closed vortices may be present or formed.

A wake region downstream of a flow separation edge may be referred to as "wake depression."

In some embodiments of the present invention, a so-called "Karman vortex street" is produced by the profile. In fluid mechanics, the term "Karman vortex street" refers to a phenomenon where counter-rotating vortices are formed behind a body in a fluid flow.

In certain embodiments of the present invention, an already formed Karman vortex street is selectively influenced by the profile according to the present invention. For example, the vortex shedding frequency may be changed in the Karman vortex street.

When the description below refers to "longitudinal vortices" or "trailing vortices" or other vortex formations, these terms are understood to include possible flow separations and/or subsequent wake regions.

Profiles at the airfoil trailing edge may be made by different manufacturing processes, including for example primary shaping (e.g., casting), secondary shaping (e.g., forging, pressing, rolling, folding, deep drawing) or material removal processes (e.g., milling, drilling), etc.

In certain exemplary embodiments according to the present invention, after the profiles have been manufactured by one of the manufacturing processes described herein, they are finished, for example, by grinding, polishing, smoothing, etc.

In several embodiments of the present invention, the profile of the airfoil is designed to shorten trailing vortices forming in the direction of flow at or behind the airfoil trailing edge. In practice, vortices, in particular longitudinal vortices, may form at the trailing edges of airfoils in a fluid flow. Shortening these longitudinal vortices in the direction of flow by means of the inventive profiles in the region of the airfoil trailing edges may advantageously result in a noise reduction and/or in a reduction in the drag of the airfoil of the present invention.

To this end, in certain embodiments of the present invention, the trailing edge of the airfoil, at least in portions thereof, has a variable height perpendicular to the direction of flow and/or perpendicular to the longitudinal direction of the airfoil trailing edge. In this embodiment, the term "direction of flow" is used to refer to the resultant direction of flow downstream of the airfoil trailing edge. This resultant flow is composed of the flows of the suction side (also referred to as the airfoil's "upper side" or "low-pressure side") and the pressure side (also referred to as the "lower side" of the airfoil).

The terms "thickness", "material thickness" or "cross dimension" may be used as synonyms for the term "height."

In several exemplary embodiments of the present invention, the airfoil trailing edge has a variable height because of the profile according to the present invention. For example, a profile region on the suction side and/or on the pressure side may have a groove, a milled cutout, a material deposit (such as a welded or adhesively bonded land), or the like, which results in a smaller or greater height in this profile region.

In certain exemplary embodiments according to the present invention, the trailing edge of the airfoil terminates with a straight longitudinal portion of the airfoil or has a straight longitudinal portion. The term "straight longitudinal portion" is used to refer to a longitudinal portion whose height may vary along its length, but which does not have any, preferably at least no significant, notches in a direction opposite to the direction of flow. The term "no significant notches" means that the longitudinal portion does not have, for example, any structural notches, but may have manufacturing irregularities, wear, surface changes, etc. Structural notches would be, for example, serrated, feather-like, gap-shaped and similar notches. Such notches reduce the width of the airfoil in the region of the respective notch. A "straight longitudinal portion" of the airfoil trailing edge may further be described by the following terms: continuous edge (of variable height) or continuous structure. A "straight longitudinal portion" may also be described by the fact that the distance between the airfoil leading edge (the flow-receiving edge of the airfoil) and the airfoil trailing edge is substantially constant across the width of the airfoil. In addition, or alternatively, a "straight longitudinal portion" may be described by the fact that in the considered portion of the airfoil trailing edge, all points located, for example, 3 cm before (upstream of) the airfoil trailing edge on the suction side are located on a straight line.

In several exemplary embodiments of the present invention, the profile has depressions at the trailing edge of the airfoil. These depressions are not to be understood as notches which extend in a direction opposite to the direction of flow and narrow the width of the airfoil, but as notches which extend perpendicularly to the surface of the airfoil trailing edge, and thus into the thickness of the airfoil trailing edge. Depressions may be made by drilling, milling, deep drawing, laser cutting, casting, etc.

In some exemplary embodiments of the present invention, at least some of the depressions of the airfoil are wedge-shaped, at least in portions thereof. The wedge-shaped depressions may taper in a direction opposite to the direction of flow.

In certain exemplary embodiments according to the present invention, the wedge-shaped depressions have an at least partially continuous taper in a direction opposite to the direction of flow. A continuous taper is understood to be a taper whose lateral boundary extends rectilinearly (see FIG. 5).

In certain embodiments according to the present invention, the wedge-shaped depressions have an at least partially non-continuous taper in a direction opposite to the direction of flow. A non-continuous taper is understood to be a taper whose lateral boundary extends curvilinearly, not rectilinearly. An embodiment of a non-continuous taper is shown in FIG. 6.

In some embodiments of the present invention, the wedge-shaped depressions taper in a direction opposite to the direction of flow in such a way that the bounding side surfaces of the taper do not converge, or, in other words, that they do not merge. Rather, an opening is left as a flow inlet into the wedge-shaped depression. Thus, a portion of the flow on the suction side and/or pressure side may enter the wedge-shaped depressions (see FIG. 7 as an exemplary embodiment).

In certain embodiments of the present invention, the transition from the surface of the suction side and/or pressure side into the wedge-shaped taper is continuous; i.e., without edges. The surfaces of the suction side and/or pressure side, on the one hand, and of the wedge-shaped depression (its base surface), on the other hand, merge smoothly into one another.

In several embodiments of the present invention, the depressions, which may be wedge-shaped, channel-shaped, or have another shape, are offset on the suction side with respect those on the pressure side. The offsets are perpendicular to the direction of flow and/or parallel to the airfoil trailing edge or along the airfoil trailing edge (see FIG. 4).

In some embodiments of the present invention, the profile, at least in portions thereof, has channel-shaped depressions in a direction opposite to the direction of flow. Channel-shaped depressions have a constant cross section, preferably throughout or at least in portions thereof (see FIG. 2).

In certain embodiments of the present invention, the profile has channel-shaped depressions, at least in portions thereof. The channel-shaped depressions are arranged such that the airfoil trailing edge forms an angle of between 0 and 90° relative to the channel longitudinal axis. When the angle is 90°, the channel longitudinal axis extends in a direction exactly opposite to the direction of flow or parallel therewith. When the angle is 0°, the channel longitudinal axis extends parallel to the airfoil trailing edge. The angle is preferably between 5° and 85°, in particular between 10° and 30°. The various channel-shaped depressions may also have different angles. This applies both on the suction side of the airfoil in the region of the airfoil trailing edge and on the corresponding pressure side. Moreover, the angles may have one particular magnitude, for example, 90°, on the suction side and a different magnitude, for example, 20°, on the pressure side. Any other combination is also possible.

In certain embodiments of the present invention, the region of the airfoil trailing edge has a hole pattern, at least in portions thereof. At least some holes (or all holes) of this hole pattern are formed as through-holes between the suction side and the pressure side in the region of the airfoil trailing edge. All or some of the holes may have a circular cross section, an oval cross section, or any other cross section.

In some embodiments of the present invention, the hole pattern has at least two rows of holes arranged in the direction of flow. A row of holes has at least two holes, and at least two rows of holes are arranged in the region of the airfoil trailing edge.

In several exemplary embodiments of the present invention, the rows of holes are arranged parallel to one another.

Some or all of the embodiments of the present invention may have one, several or all of the advantages mentioned above and/or hereinafter.

The airfoil of the present invention may be advantageously used in the arrays of stator vanes of a low-pressure turbine. By shortening the longitudinal vortices downstream of the stator vane arrays through the use of the inventive airfoils with the above-described profiles in the region of the airfoil trailing edges, it may be possible, for example, for subsequent, downstream arrays of rotor blades to be affected less or not at all. This makes it possible, at least, to reduce the noise produced at the subsequent rotor blades, because the shortened longitudinal vortices do not reach the subsequent rotor blade arrays. Overall, this results in an advantageous reduction in noise during flow through the turbine.

For structural/mechanical reasons, the profiling of airfoil trailing edges is advantageously more convenient for stator vanes than for rotor blades, because stator vanes are not subjected to the high speeds, and thus not to any additional dynamic loads. This reduced loading of the static stator vanes leads to a reduced susceptibility to failure, a longer service life, and ultimately to increased economy of operation when using the airfoil of the present invention as compared to conventional airfoils.

By using the airfoil according to the present invention, the minimum axial spacing (in the direction of flow) between the arrays of stator vanes and/or the arrays of rotor blades may advantageously be reduced because the trailing vortices may be shortened.

As a result, the subsequent or adjacent blades are excited or affected to a lesser extent.

Furthermore, when using the airfoil according to the present invention, it is advantageously possible to achieve a lower loss coefficient for the airfoil profile, and thus to reduce the axial length of the airfoil profile or the number of blades.

Alternatively or additionally, for an unchanged length (longitudinal extent in the direction of flow) of the airfoil profile or for an unchanged number of blades, the efficiency (for example, the hydraulic efficiency of the airfoil) may be increased when using the airfoil of the present invention as compared to non-inventive embodiments without the profile according to the present invention.

Due to the advantages mentioned above, the use of the inventive airfoil may advantageously result in a reduction in weight of the engine, a reduction in cost, a reduction in length of the turbine and/or in an increase in efficiency.

BRIEF DESCRIPTION OF THE DRAWINGS

The present invention will now be described, by way of example only, with reference to the accompanying drawings, in which identical or similar components are indicated by the same reference numerals. The figures are, in part, greatly simplified views, of which.

DETAILED DESCRIPTION

Figure 1:
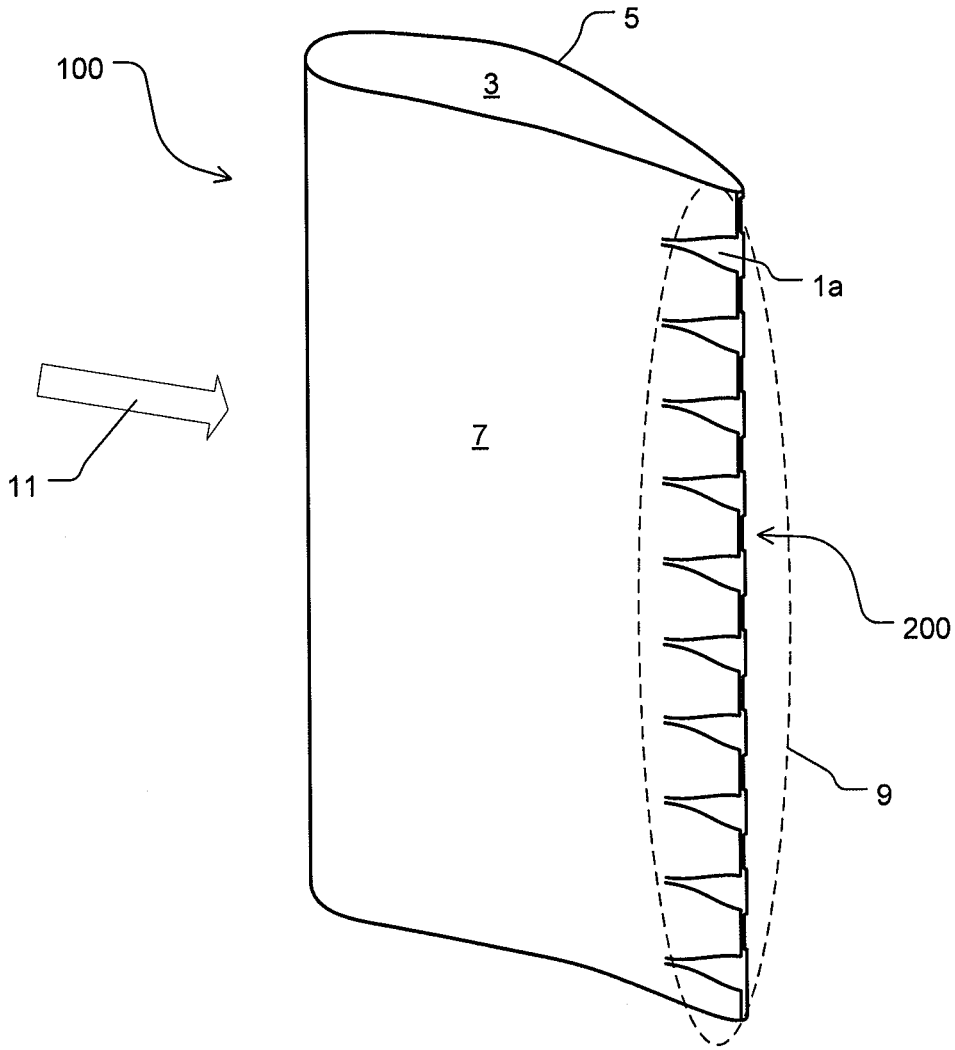
FIG. 1 is a schematic view of an airfoil having wedge-shaped depressions according to a first embodiment of the present invention.
Figure 8:
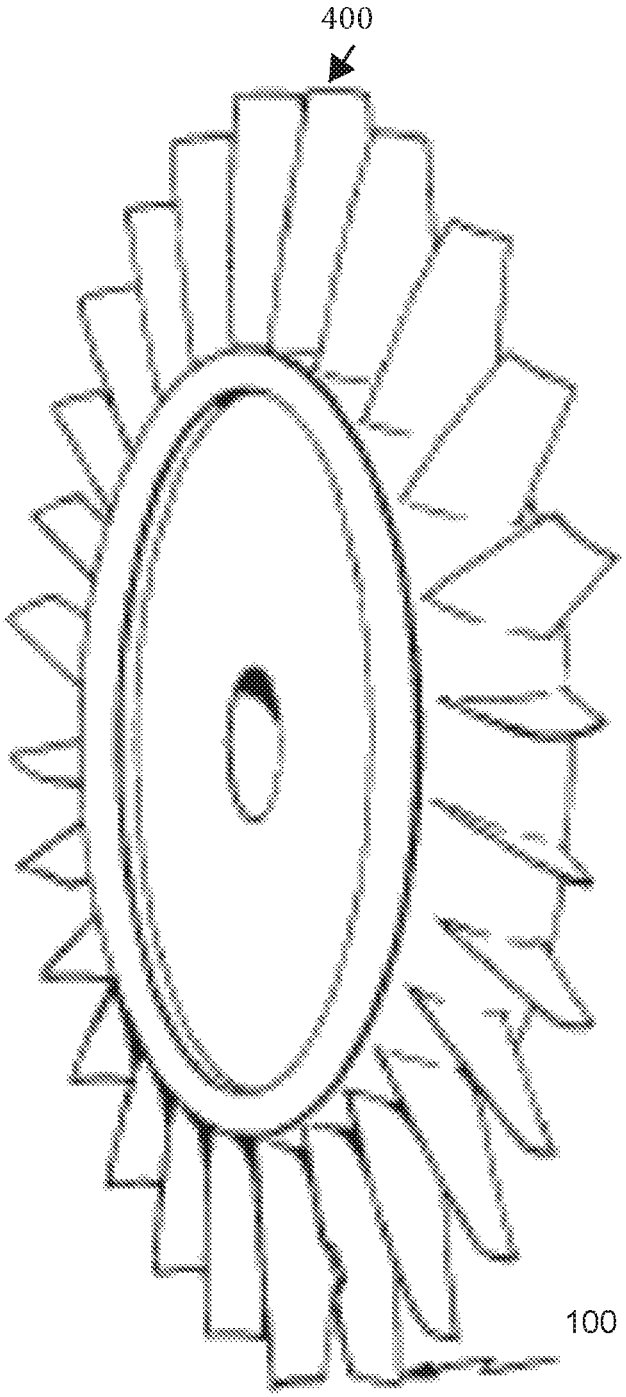
FIG. 8 schematically illustrates an integrally bladed rotor.

FIG. 1 schematically shows an airfoil 100 according to the present invention, having an airfoil profile 3, a suction side 5 and a pressure side 7. Airfoil 100 has wedge-shaped depressions 1 in the region of airfoil trailing edge 200. FIG. 8 shows an integrally bladed rotor 400 including the airfoil 100 as a blade of the rotor.

In the region of airfoil trailing edge 200, there is shown a profile 9 having wedge-shaped depressions 1 both on suction side 5 (merely indicated as dashes in FIG. 1) and on pressure side 7, in each case in the region of airfoil trailing edge 200. Wedge-shaped depressions 1 taper in a direction opposite to the direction of flow 11.

Figure 2:
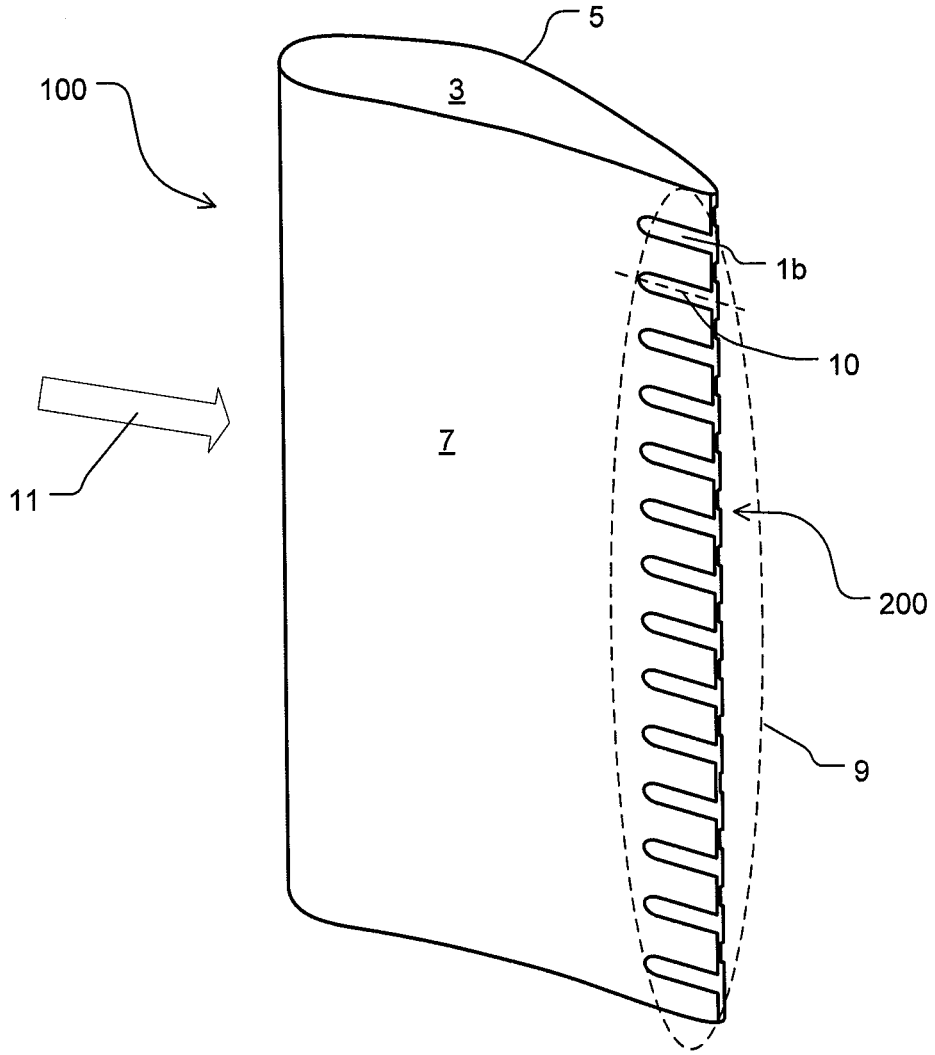
FIG. 2 is a schematic view of another airfoil having channel-shaped depressions according to a second embodiment of the present invention.

FIG. 2 schematically shows another airfoil 100 according to the present invention, which has channel-shaped depressions 1*b* in the region of airfoil trailing edge 200. Channel-shaped depressions 1*b* have a channel longitudinal axis 10 and terminate in a semicircular shape. Such channel shapes are formed, for example, by means of a milling cutter.

The depressions may be formed both in the direction of flow (or opposite thereto) (depressions 1*b*) and perpendicular to the surface and perpendicular to the direction of flow (not shown in FIG. 2). The depressions perpendicular to the surface may have different depths both in the direction of flow (or opposite thereto) and perpendicular to the direction of flow. Accordingly, for example, a material-removal manufacturing process may be carried out three-dimensionally in all three machining angles (x, y, z axes).

Channel-shaped depressions 1*b* extend over pressure side 7 and suction side 5 (in FIG. 2, the depressions on suction side 5 are merely indicated as dashes at airfoil trailing edge 200) and together form a profile 9 in the region of airfoil trailing edge 200.

Figure 3:
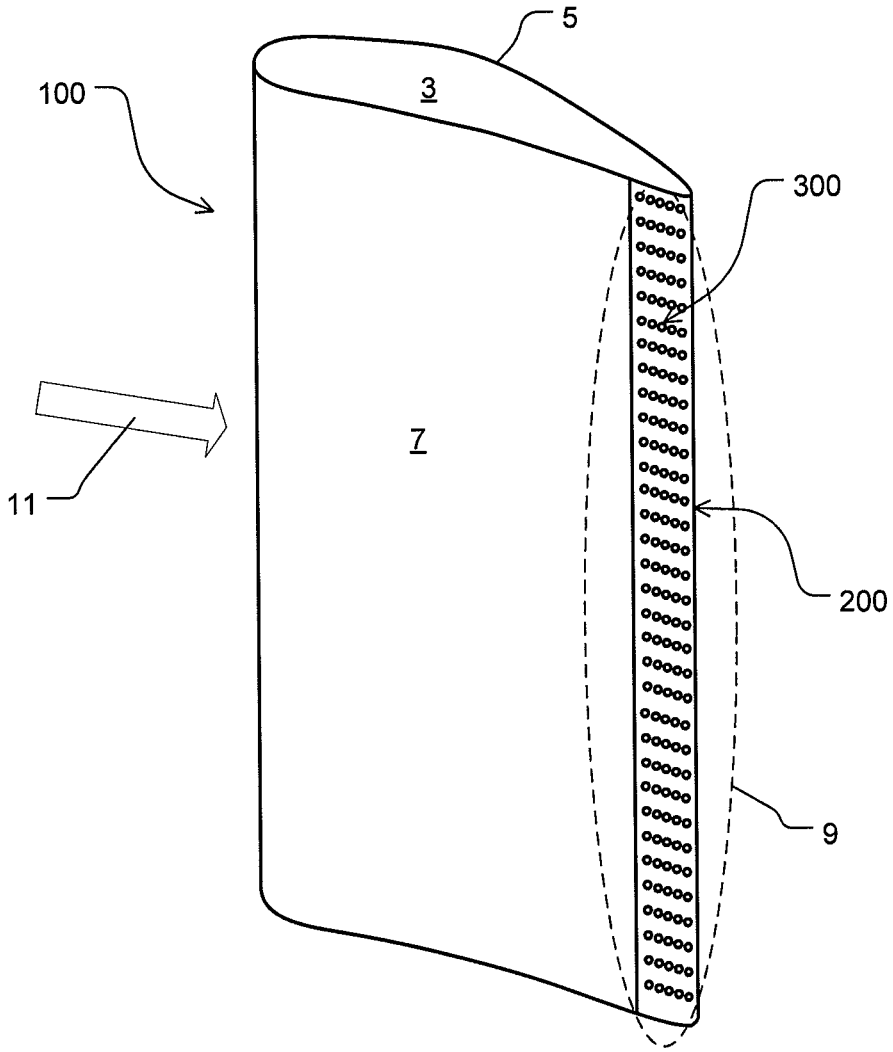
FIG. 3 is a schematic view of a further airfoil having a hole pattern according to a third embodiment of the present invention.

FIG. 3 schematically shows another airfoil 100 according to the present invention, which has a hole pattern 300 in the region of airfoil trailing edge 200. Merely by way of example, the individual holes of this hole pattern 300 are formed as through-holes. Alternatively, however, all or a portion of the holes may be formed as non-through holes (blind bores with depths to be determined individually). These bores may be formed differently on suction side 5 and pressure side 7.

In this exemplary embodiment of the present invention, hole pattern 300 is in the form of parallel rows of holes in the direction of flow 11 (here, by way of example, 5 holes per row), but any other arrangement is also possible and within the scope of the present invention.

Figure 4A:
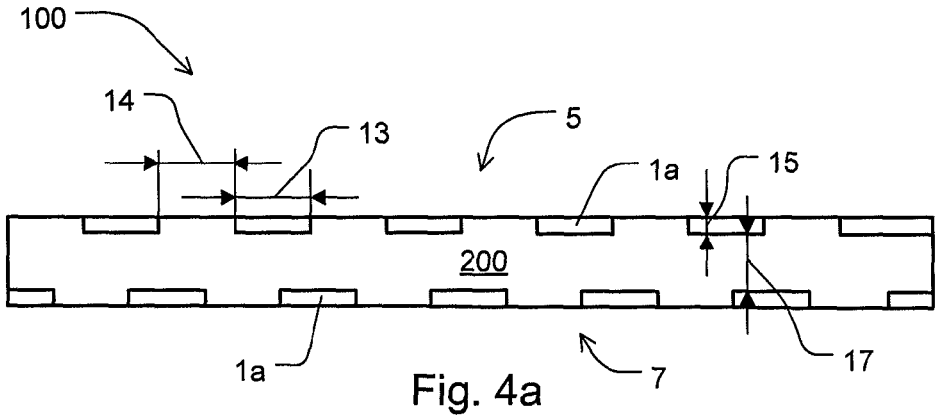
FIG. 4*a* is a schematic view illustrating an arrangement of wedge-shaped depressions at the airfoil trailing edge according to the first embodiment, with straight lateral boundaries in cross section.

FIG. 4*a* schematically shows an arrangement of wedge-shaped depressions 1*a* at airfoil trailing edge 200 in a front view looking at airfoil trailing edge 200 in a direction opposite to the direction of flow 11 (see FIGS. 1 to 3).

In the view of FIG. 4*a*, wedge-shaped depressions 1*a* are arranged on suction side 5 (at the top) and on pressure side 7 (at the bottom) in the region of airfoil trailing edge 200. Thus, they are located above and below the continuous portion of the airfoil trailing edge.

The position of wedge-shaped depressions 1*a* on suction side 5 is offset with respect to pressure side 7 or, vice versa, that on pressure side 7 is offset with respect to suction side 5. "Offset" means that wedge-shaped depressions 1*a* in the longitudinal direction of airfoil trailing edge 200 are not disposed at the same position in the longitudinal direction (i.e., in the left-to-right direction in FIG. 4*a*). The offset of wedge-shaped depressions 1*a* may be regular; i.e., one wedge-shaped depression 1*a* on suction side 5, then one on pressure side 7, followed by one on suction side 5, etc., or irregular. It may be regularly irregular or irregularly irregular.

The width 13 of the wedge-shaped depressions 1*a* at airfoil trailing edge 200 on suction side 5 may be constant or variable. The same applies to the wedge-shaped depressions 1*a* on pressure side 7.

Similarly, the width 14 of the areas between the wedge-shaped depressions 1*a* on suction side 5 may be constant or variable. The same applies to width 14 of the areas between the wedge-shaped depressions 1*a* on pressure side 7.

Also, the depth 15 of the wedge-shaped depressions 1*a* at airfoil trailing edge 200 on suction side 5 may be constant or variable. The same applies to the wedge-shaped depressions 1*a* on pressure side 7. Depth 15 may be constant or variable across profile 9. For example, depth 15 may be greater directly at airfoil trailing edge 200 and decrease across suction side 5 and/or across pressure side 7, or vice versa; i.e., it may first be smaller at airfoil trailing edge 200 and increase subsequently.

The height 17 of airfoil trailing edge 200 indicates the minimum cross dimension or thickness of the continuous airfoil trailing edge 200. I.e., the reference dimension for the height 15 is the total height of airfoil trailing edge 200 minus the depth 15 of the wedge-shaped depressions 1*a* on suction side 5 and pressure side 7. Height 17 may be an important dimension for the mechanical and dynamic stability of airfoil trailing edge 200 and/or the entire airfoil 100.

What applies to the depressions or areas of one geometry (e.g., wedge-shaped) anywhere herein (i.e., not only with respect to the figure described here), applies also to all other possible depressions, areas or forms of depressions of other geometries (e.g., channel-shaped depressions).

Merely by way of example, the dimensions mentioned may be as follows: width 13 of depressions 1*a* is in a range between 0.5 and 2 mm, preferably between 0.8 and 1.2 mm, in particular 1 mm; depth 15 is in a range between one-tenth and one-fourth of height 17 (e.g., in a range between 0.1 and 0.25 mm), in particular one-sixth of height 17 (e.g., 0.2 mm); height 17 is in a range between 0.5 and 2 mm, preferably between 0.8 and 1.2 mm, in particular 1 mm; width 14 is in a range between 0.5 and 2 mm, preferably between 0.8 and 1.2 mm, in particular 1 mm.

All dimensions may in particular be dependent on the blade size.

In the exemplary embodiment illustrated here, both of (alternatively only one of) the lateral boundaries of depressions 1*a* extend straight. Thus, in this example, they extend into the depth of the airfoil 100 perpendicularly to the surface thereof.

Figure 4B:
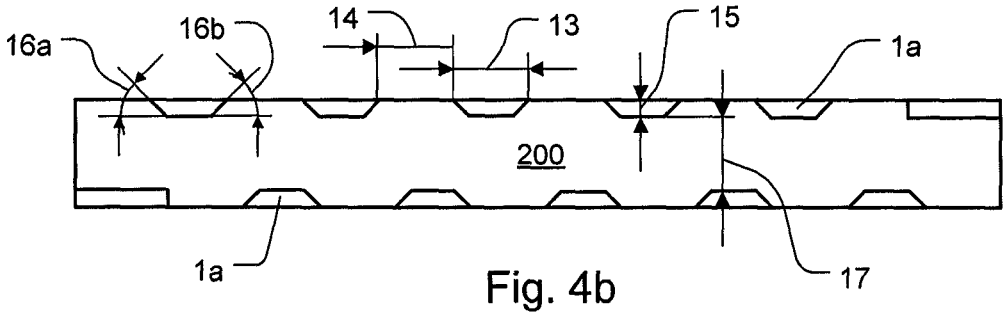
FIG. 4*b* is a view showing an arrangement of wedge-shaped depressions with inclined lateral boundaries in cross section.
Figure 4C:
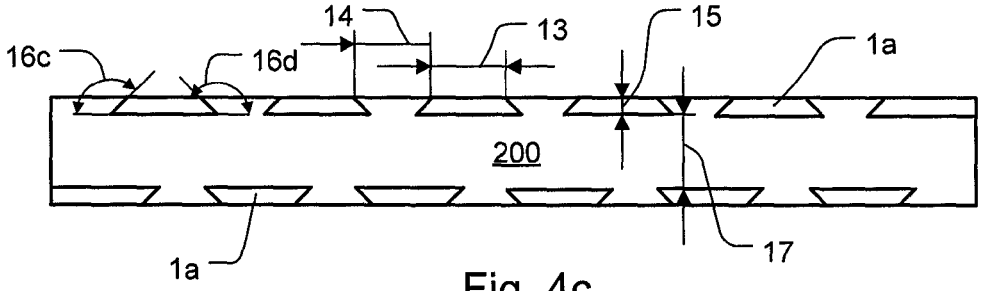
FIG. 4*c* is a view showing another arrangement of wedge-shaped depressions with inclined lateral boundaries in cross section.
Figure 4D:
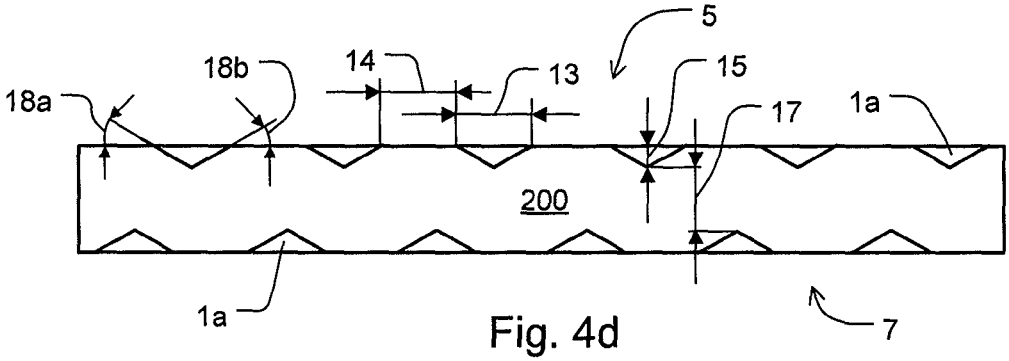
FIG. 4*d* is a view showing an arrangement of wedge-shaped depressions which extend both in the direction of flow and perpendicularly to the upper and lower sides of the airfoil.

Other possible embodiments of the profile are illustrated in FIGS. 4*b*, 4*c*, 4*d*, in which both of (alternatively only one of) the lateral boundaries of depressions 1*a* do not extend straight as seen in the cross-sectional views of airfoil 100 shown in the respective figures. Thus, in this example, they not extend into the depth of the airfoil 100 perpendicularly to the surface thereof. In contrast to the parallel embodiment shown in FIG. 4*a*, they are not parallel to one another.

FIG. 4*b* shows depressions 1*a* whose lateral boundaries are slanted at angles 16*a*, 16*b* in the plane of the drawing of FIG. 4*b* with respect to the respective side. Merely by way of example, angles 16*a*, 16*b* may be between 30 and 60 degrees, preferably between 40 and 50 degrees, in particular 45 degrees.

Angles 16*a*, 16*b* may be of equal or different magnitude.

FIG. 4*c* shows depressions 1*a* whose sides are slanted at other angles 16*c*, 16*d*. Merely by way of example, angles 16*c*, 16*d* may be between 120 and 150 degrees, preferably between 130 and 140 degrees, in particular 135 degrees.

Angles 16*c*, 16*d* may be of equal or different magnitude.

The form of depression 1*a* and its two boundary faces shown in FIG. 4*c* may also be referred to as "dovetail shape", whose width is greater at the bottom of depression 1*a* than at the mouth thereof. In structural terms, this shape is also referred to as "undercut", which may, for example, be in the form of a trapezoid.

FIG. 4*d* is a view showing an arrangement of wedge-shaped depressions 1*a* which extend both in the direction of flow (perpendicular to the plane of the drawing) and perpendicularly to upper side 5 and lower side 7 of the airfoil.

Wedge-shaped depressions 1*a* have angles 18*a* and 18*b* with respect to the upper side 5 and lower side 7 of the airfoil.

Merely by way of example, angles 18*a*, 18*b* may be between 10 and 50 degrees, preferably between 20 and 30 degrees, in particular 30 degrees.

Angles 18*a*, 18*b* may be of equal or different magnitude.

The embodiments of FIGS. 4*a*, 4*b* and 4*c* may be advantageous from a production point of view since the depth 15 of the wedge-shaped depressions may be predefined, thereby also defining the height 17 of the airfoil trailing edge. In contrast, in the embodiment of FIG. 4*d*, height 15 varies with the angles 18*a* and 18*b*, and more specifically, height 17 decreases with increasing angles 18*a*, 18*b*. In addition, the stability of airfoil trailing edge 200 may be advantageous in the case of a predefined minimum height 17, as in the embodiments of FIGS. 4*a*, 4*b* and 4*c*.

Furthermore, in the case of predefined minimum heights 17, the stability of airfoil trailing edge 200 may be advantageous, in particular in the case of dynamic and/or flow-related loading of airfoil profile 3. Moreover, an airfoil trailing edge profile 200 of the embodiments 4*a* through 4*c* with defined minimum heights 17 may be advantageous because, for example, in the case of small material thicknesses (small height 17), chip-removing machining of depressions 1*a* at least requires additional effort during clamping of the workpiece.

Figure 5:
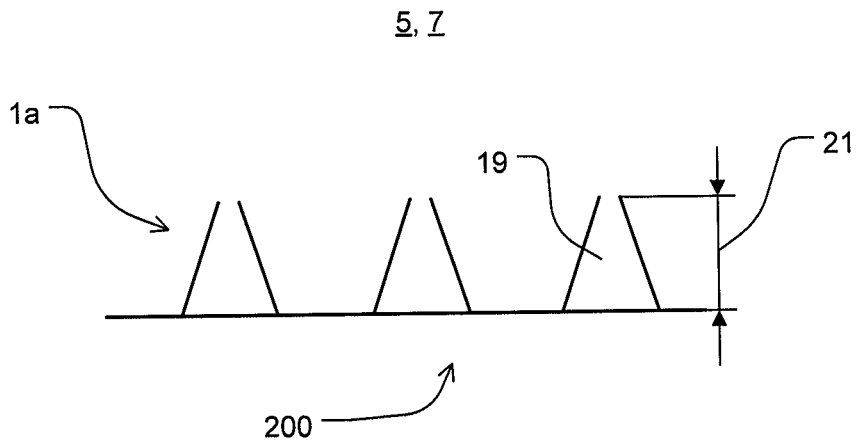
FIG. 5 is a schematic view illustrating the shape of a continuously tapering wedge-shaped depression according to a fourth embodiment.

FIG. 5 schematically shows the shape of a wedge-shaped depression 1*a* having a continuous taper 19 on suction side 5 and/or pressure side 7 in the region of airfoil trailing edge 200 in a plan view of suction side 5 and/or pressure side 7.

Length 21 indicates how far wedge-shaped depression 1*a* extends from airfoil trailing edge 200 over suction side 5 and/or pressure side 7.

Merely by way of example, length 21 may be 1.2 mm or alternatively in a range between 0.9 and 1.8 mm.

Figure 6:
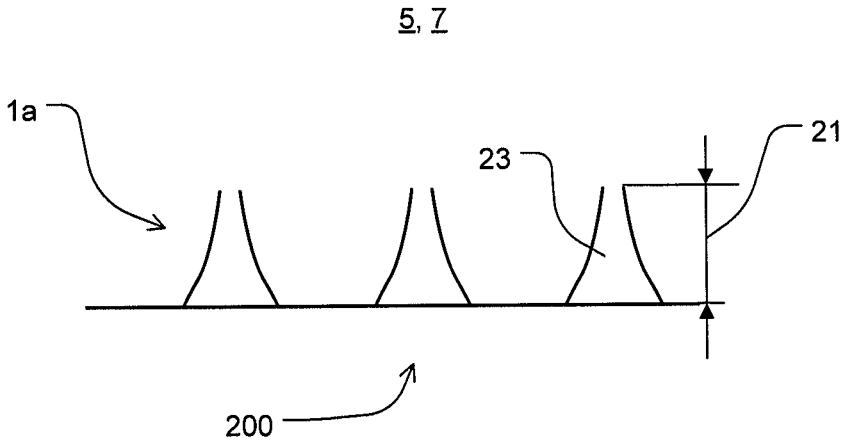
FIG. 6 is a schematic view illustrating the shape of a non-continuously tapering wedge-shaped depression according to a fifth embodiment.

FIG. 6 schematically shows the shape of a wedge-shaped depression 1*a* having a non-continuous taper 23 on suction side 5 and/or pressure side 7 in the region of airfoil trailing edge 200 in a plan view from above (of suction side 5) or from below (of pressure side 7).

The description of length 21 given with respect to FIG. 5 applies here analogously.

Figure 7:
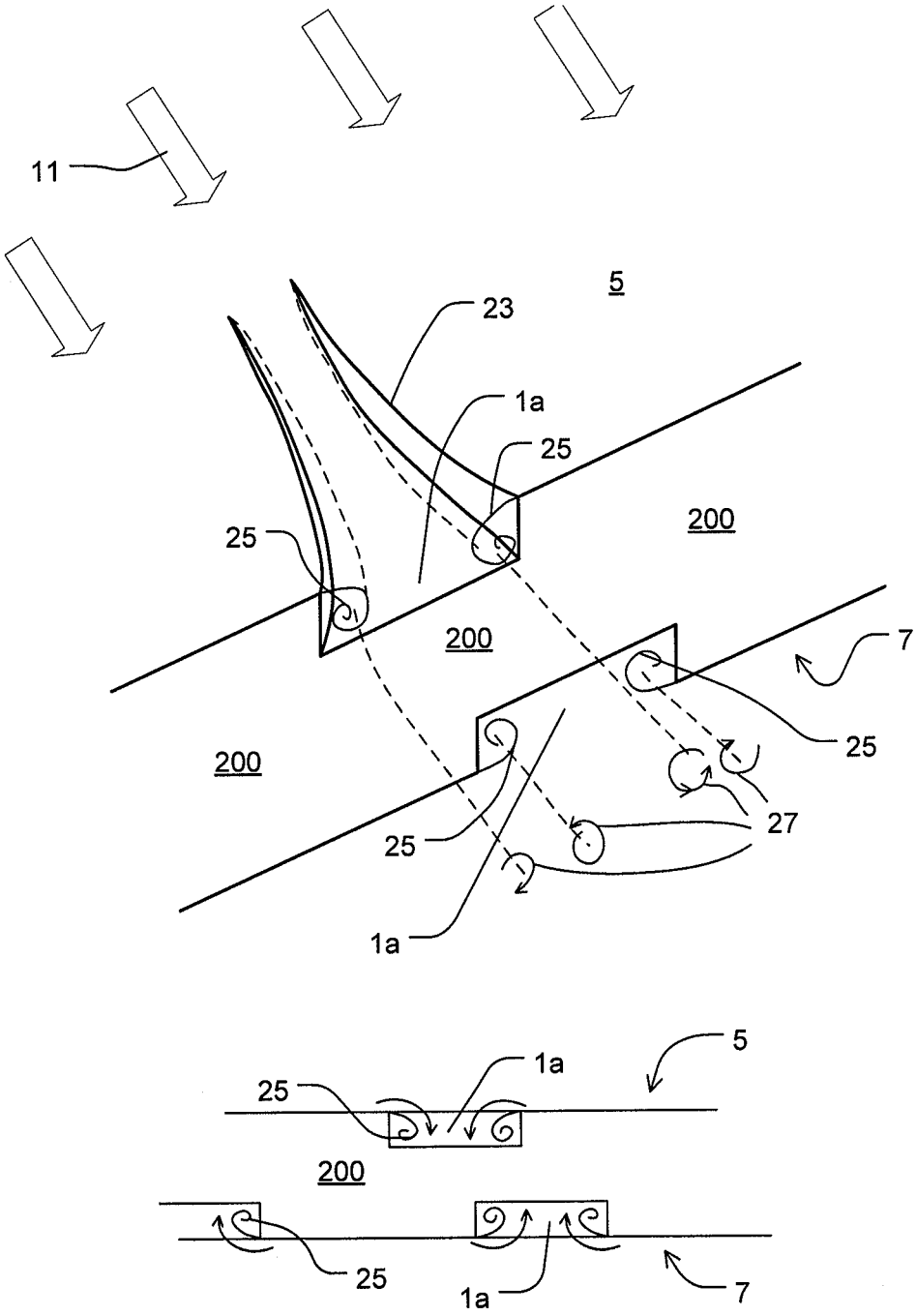
FIG. 7 is a schematic view showing wedge-shaped depressions at the airfoil trailing edge and vortex formations.

FIG. 7 schematically illustrates wedge-shaped depressions 1*a* at airfoil trailing edge 200 and vortex formations in a perspective view (from above) and in a view looking at airfoil trailing edge 200 from downstream thereof.

Wedge-shaped depression 1*a* is illustrated by a non-continuous taper (in a direction opposite to the direction of flow 11, see FIG. 6).

Direction of flow 11 causes flows around both suction side 5 and pressure side 7. For example, a portion of the flow flows from suction side 5 into wedge-shaped depression 1*a*. The surface of the suction side merges smoothly into wedge-shaped depression 1*a*. In other words, the transition between the two surfaces is continuous without edges.

During flow through wedge-shaped depressions 1*a*, vortices 25 are formed at the two side walls of wedge-shaped depressions 1*a*. The formation of these vortices 25 may depend on the velocity of flow and/or on the widening shape of wedge-shaped depressions 1*a*. A shape that widens more strongly may promote the formation of vortices more than a shape that widens less.

The formation of pairs of vortices 25 (at the two side walls of the respective wedge-shaped depressions 1*a*) results in strong mixing of the entire flow from the suction and pressure sides in the region of wedge-shaped depressions 1*a* in the subsequent flow region downstream of airfoil trailing edge 200. This mixing is illustrated by the additional vortices 27 downstream of airfoil trailing edge 200. This mixing reduces the length of the trailing vortices downstream of airfoil trailing edge 200. As described earlier (above) in the description, the term "trailing vortex" is understood to include, inter alia, longitudinal vortices and, in particular, wake regions.

The shortening of the trailing vortices and/or wake regions results in the advantages described above such as, for example, reduced generation of noise and/or increased efficiency and/or less vibration excitation of subsequent blades located further downstream.

List of Reference Numerals

| Reference Numeral | Description |
|---|---|
| 100 | airfoil for a fluid flow machine, turbine blade |
| 200 | airfoil trailing edge |
| 300 | hole pattern |
| 1a | wedge-shaped depression |
| 1b | channel-shaped depression |
| 3 | airfoil profile |
| 5 | suction side; upper side of the airfoil |
| 7 | pressure side; lower side of the airfoil |
| 9 | profile in the region of the airfoil trailing edge |
| 10 | channel longitudinal axis |
| 11 | direction of flow |
| 13 | width of the wedge-shaped depression at the airfoil trailing edge |
| 14 | width of the areas between wedge-shaped depressions 1a |
| 15 | depth of the wedge-shaped depression at the airfoil trailing edge |
| 16a, 16b, 16c, 16d | angles of the lateral boundaries (slants) of depressions 1a |
| 17 | height of the airfoil trailing edge |
| 18a, 18b | angle of wedge-shaped depressions 1a |
| 19 | continuous taper of a wedge-shaped depression in the region of the airfoil trailing edge |
| 21 | length of the wedge-shaped depression at the airfoil trailing edge |
| 23 | non-continuous taper of a wedge-shaped depression in the region of the airfoil trailing edge |
| 25 | vortex/wake region in the wedge-shaped depression |
| 27 | vortex/wake region downstream of the airfoil trailing edge |

What is claimed is:

1. An airfoil for a fluid flow machine, comprising:

a suction side;

a pressure side;

an airfoil trailing edge; and a profile in at least part of a region of the airfoil trailing edge, the profile extending over the suction side and the pressure side of the airfoil trailing edge;

wherein the profile has depressions, the depressions being wedge-shaped with a flat base and having a taper in a direction opposite to the direction of flow.

2. The airfoil as recited in claim 1 wherein the profile is designed to shorten trailing vortices forming in the direction of flow.

3. The airfoil as recited in claim 1 wherein the airfoil trailing edge at least in portions thereof has a variable height perpendicular to the direction of flow and perpendicular to the longitudinal direction of the airfoil trailing edge.

4. The airfoil as recited in claim 1 wherein the airfoil trailing edge terminates with a straight longitudinal portion of the airfoil.

5. The airfoil as recited in claim 1, wherein the wedge-shaped depressions have an at least partially continuous taper in a direction opposite to the direction of flow.

6. The airfoil as recited in claim 1 wherein the wedge-shaped depressions have an at least partially non-continuous taper in a direction opposite to the direction of flow.

7. The airfoil as recited in claim 1, wherein the depressions on the suction side being offset with respect to the depressions on the pressure side, and wherein the offsets are perpendicular to the direction of flow or parallel to the airfoil trailing edge or along the airfoil trailing edge.

8. A blade comprising an airfoil as recited in claim 1.

9. An integrally bladed rotor comprising at least one airfoil as recited in claim 1.

* * * * *